US008797230B2

(12) United States Patent
Leisten

(10) Patent No.: US 8,797,230 B2
(45) Date of Patent: Aug. 5, 2014

(54) ANTENNA FOR CIRCULARLY POLARIZED RADIATION

(75) Inventor: Oliver Paul Leisten, Northampton (GB)

(73) Assignee: Harris Corporation, Melbourne, FL (US)

( * ) Notice: Subject to any disclaimer, the term of this patent is extended or adjusted under 35 U.S.C. 154(b) by 221 days.

(21) Appl. No.: 13/193,888

(22) Filed: Jul. 29, 2011

(65) Prior Publication Data

US 2012/0026066 A1 Feb. 2, 2012

Related U.S. Application Data

(60) Provisional application No. 61/370,953, filed on Aug. 5, 2010.

(30) Foreign Application Priority Data

Jul. 30, 2010 (GB) ..... 1012923.7

(51) Int. Cl.
*H01Q 1/36* (2006.01)

(52) U.S. Cl.
USPC ..... 343/895; 343/700 MS

(58) Field of Classification Search
USPC ..... 343/700 MS, 795, 797, 895
See application file for complete search history.

(56) References Cited

U.S. PATENT DOCUMENTS

| | | | | |
|---|---|---|---|---|
| 2,953,781 A | | 9/1960 | Donnellan et al. | |
| 3,137,002 A | | 6/1964 | Kaiser, Jr. et al. | |
| 3,562,756 A | | 2/1971 | Kuo et al. | |
| 4,658,262 A | | 4/1987 | DuHamel | |
| 5,014,070 A | * | 5/1991 | Stock et al. | 343/700 MS |
| 5,220,340 A | | 6/1993 | Shafai | |
| 5,451,973 A | | 9/1995 | Walter et al. | |
| 5,973,644 A | * | 10/1999 | Haneishi et al. | 343/700 MS |
| 7,633,460 B2 | | 12/2009 | Camp et al. | |

(Continued)

FOREIGN PATENT DOCUMENTS

| | | |
|---|---|---|
| EP | 1 930 980 A1 | 6/2008 |
| GB | 2471578 A | 1/2011 |

(Continued)

OTHER PUBLICATIONS

International Preliminary Report on Patentability and Written Opinion for International Application No. PCT/GB2011/001120 dated Feb. 5, 2013.

(Continued)

*Primary Examiner* — Tan Ho
(74) *Attorney, Agent, or Firm* — Alston & Bird LLP

(57) ABSTRACT

An antenna for circularly polarized radiation at an operating frequency in excess of 200 MHz has a substrate in the form of a disc-shaped dielectric tile with parallel planar surfaces. The upper surface bears a conductive pattern including a resonant ring and a number of open-circuit radiating elements each having an electrical length of a quarterwave at the resonant frequency of the ring. The radiating elements extend outwardly from the ring and are joined to the ring at uniformly spaced locations. Each radiating element extends in a direction which has both a radial component and a tangential component and follows a generally spiral path. A pair of central feed nodes are coupled to the inside of the ring by a pair of feed tracks lying on a diameter. Dual-frequency and dual-polarization variants are also disclosed.

29 Claims, 6 Drawing Sheets

(56) References Cited

U.S. PATENT DOCUMENTS

| | | | | |
|---|---|---|---|---|
| 2002/0067315 | A1 | 6/2002 | Kunysz | |
| 2003/0210193 | A1 | 11/2003 | Rossman et al. | |
| 2004/0113727 | A1 | 6/2004 | Kawai | |
| 2007/0262902 | A1* | 11/2007 | Iwata et al. | 343/700 MS |
| 2008/0143536 | A1 | 6/2008 | Camp et al. | |
| 2011/0001680 | A1 | 1/2011 | Leisten | |

FOREIGN PATENT DOCUMENTS

| | | | |
|---|---|---|---|
| JP | 2003-507915 | A | 2/2003 |
| JP | 2004-208275 | A | 7/2004 |
| JP | 2004-266438 | A | 9/2004 |
| JP | 2006-128902 | A | 5/2006 |
| JP | 2006-196974 | A | 7/2006 |
| JP | 2009-502058 | A | 1/2009 |
| WO | WO 01/13465 | A1 | 2/2001 |
| WO | WO 2007/009216 | A1 | 1/2007 |

OTHER PUBLICATIONS

International Search Report from International Patent Application No. PCT/GB2011/001120, filed Jul. 26, 2011.

Search Report from Great Britain Application No. 1012923.7, filed Jul. 30, 2010.

Search Report for Great Britain Application No. GB1112884.0 dated Nov. 9, 2011.

Wakatsuki, H. et al., *Multi-ring microstrip antennas for circular polarization in a single-layer dielectric substrate*, The Institute of Electronics, Information and Communication Technology Technical Report, vol. 109, No. 454, A P2009-213 (Mar. 1, 2010), pp. 49-54.

Office Action for Japanese Application No. 2003-522286 dated Apr. 1, 2014.

* cited by examiner

ANTENNA FOR CIRCULARLY POLARIZED RADIATION

CROSS REFERENCE TO RELATED APPLICATION

This application claims the benefit of the filing date of commonly owned copending Provisional Application No. 61/370,953 filed Aug. 5, 2010, incorporated in its entirety herein by reference.

FIELD OF THE INVENTION

This invention relates to an antenna for circularly polarised radiation at an operating frequency in excess of 200 MHz and having an electrically insulative substrate disposed between a conductive pattern and a ground plane and to an antenna component comprising an antenna element pattern on a substrate.

BACKGROUND OF THE INVENTION

It is known to receive circularly polarised signals using a patch antenna. Such an antenna comprises a dielectric substrate having parallel upper and lower planar surfaces. Typically the upper surface bears a conductive layer with a rectangular outline and the lower surface has another conductive layer acting as a ground plane. According to the feed configuration, the antenna is sensitive to circularly polarised radiation reaching the antenna from a direction generally above and perpendicular to the upper surface.

Another antenna for circularly polarised radiation is a turnstile antenna. A turnstile antenna typically comprises a set of two dipole antennas which are aligned in a common plane at right angles to each other and which are fed 90 degrees out-of-phase. When mounted with its axis vertical, a turnstile antenna provides an almost omnidirectional circularly polarised radiation pattern with a vertically directed maximum. It is known to add a reflector underneath the dipole elements of a vertical axis turnstile antenna. The antenna pattern can be altered by changing the distance between the reflector and the dipole elements.

It is an object of this invention to provide an improved antenna for receiving and/or transmitting polarised radiation.

SUMMARY OF THE INVENTION

According to one aspect of the invention, there is provided an antenna for circularly polarised radiation at an operating frequency in excess of 200 MHz, comprising an insulative substrate, a conductive ground plane and a conductive pattern, wherein at least a portion of the substrate is disposed between the conductive pattern and the ground plane, the conductive pattern includes a resonant ring and a plurality of open-circuit stubs coupled to the resonant ring and extending outwardly therefrom, a plurality of the stubs have an electrical length of a quarter wavelength at the resonant frequency of the resonant ring to which they are coupled. Use of a conductive resonant ring provides an efficient antenna with a resonant frequency dependent on the electrical length of the resonant ring. Stubs with an electrical length of a quarter wavelength at the resonant frequency of the resonant ring further increase the efficiency of the antenna as radiation incident on each stub at the resonant frequency of the resonant ring excites a standing wave in the stub.

Preferably, both the conductive pattern and the ground plane are planar, being plated or otherwise formed as layers on parallel, oppositely directed surfaces of the substrate. The stubs extend outwardly from the resonant ring in a direction having both a radial component and a tangential component. In particular, they may each have a spiral form. The substrate is advantageously made of a ceramic material having a relative dielectric constant of at least 5. The thickness of the substrate is generally less than 15 degrees of the wavelength of a wave, in the substrate medium, at the resonant frequency of the resonant ring, and is most preferably less than 10 degrees (i.e. less than about 0.04 $\lambda g$ or 0.0275 $\lambda g$ where $\lambda g$ is the wavelength of an electromagnetic wave in the substrate medium). Typically, therefore, the substrate thickness is less than 5 mm for an L-band or S-band antenna. Also, typically, the substrate thickness is less than a quarter of its average transverse extent. In such an antenna, the ring and the quarter-wave stubs provide a resonant structure having a circularly polarised mode of resonance at the operating frequency, with a radiation pattern which is substantially omnidirectional in azimuth and has an upwardly directed maximum when the antenna is mounted with the conductive pattern and ground plane horizontal and the ground plane beneath the conductive pattern.

The antenna may have a balanced antenna feed connection at the centre of a circular or square ring with feed paths extending generally radially inwardly from the resonant ring to a pair of feed connection nodes. When the antenna is energised at the operating frequency, a standing wave forms around the resonant ring. If there are four stubs equally spaced around the resonant ring, each stub resonates at 90 degrees out-of-phase with each adjacent stub and at 180 degrees out-of-phase with the opposite stub.

The bandwidth of the antenna may be manipulated by increasing or decreasing the volume of the antenna. The thickness of the substrate of the antenna can, therefore, be used to set the bandwidth of the antenna. As the thickness of the substrate between the radiating elements and the ground plane decreases, more energy is stored in the capacitances and inductances of the elements of the conductive pattern, so that less energy is radiated.

The Q-factor of an antenna can be described as the ratio of the energy stored to the energy dissipated per cycle. It follows that the Q-factor of the antenna increases as the thickness of the substrate decreases.

As stated previously, the pattern of the antenna can be altered by changing the distance between the ground plane (reflector) and the conductive pattern. The closer the ground plane and the conductive pattern are, the greater is the vector addition of the reflected backward radiating wave and the forward radiating wave. To maximise the forward radiating wave, the thickness of the substrate should therefore be minimised.

Making the relative dielectric constant of the substrate of the antenna typically greater than 5 provides a greater permittivity for the substrate of the antenna than that of the materials most likely to surround the antenna when installed, e.g. structural plastics. The greater permittivity of the substrate increases the efficiency of the antenna due to dielectric loading of the antenna.

In one embodiment of the invention, the antenna has two feed paths extending radially outwardly from a central feed connection towards the resonant ring and couple to the resonant ring. The feed paths have characteristic impedances identical to each other. The feed paths couple to the resonant ring at points separated by half of the wavelength of a standing wave of the resonant ring, i.e. generally at diametrically opposite locations, and, at their inner ends, form a feed connection to which further circuitry is connected when the antenna is installed in equipment. The further circuitry does not form part of the antenna. It is preferred that a connection is made from the conductive pattern on the top surface of the antenna through the substrate and the ground plane to equipment wiring situated below the ground plane. In this arrangement, the ground plane shields the conductive pattern from signals radiated by the wiring below the ground plane, and visa versa. It is possible to use either a single bore or aperture in the substrate and ground plane or two separate bores in both the substrate and the ground plane to allow connections between the conductive pattern and wiring situated below the ground plane. In the case of a single bore, tracks forming radial feed paths originating at the resonant ring may continue as plated tracks on opposite sides of the bore in the substrate to circuitry provided below the ground plane. If two bores are used, only a single feed path continues down each bore from the resonant ring to circuitry provided below the ground plane, each bore constituting a plated via.

In a further embodiment of the invention, the conductive pattern does not comprise a feed path on the uppermost surface of the antenna. Instead, the resonant ring is directly coupled to circuitry below the ground plane through two bores in the substrate and ground plane. In this embodiment, the bores are located in registry with the resonant ring and the feed paths comprise the plated walls of the bores. In such an embodiment, the feed paths may comprise radial tracks plated on the underside of the substrate.

Although in the above-described two embodiments feed paths extend down the side of the or each bore in the substrate, it is also possible for connections to be made from the conductive pattern to circuitry below the ground plane using other means. For example, a wire, attached to both the resonant ring above the substrate and the circuitry provided below the ground plane may replace the section of the feed path running down the side of the bore in the substrate.

It is known that as the frequency of an alternating signal in a conductor increases, the associated current is concentrated closer to the edge or surface of the conductor. At UHF and upwards the majority of the charge is carried at the edges or surface of a conductor. In such circumstances, if the resonant ring is formed as a conductive track of sufficient width it effectively comprises an inner resonant path and an outer resonant path of different electrical lengths, whereby the resonant paths have different resonant frequencies. Accordingly, a single conductive ring can have a plurality of two resonant frequencies, e.g. a first resonant frequency associated with the inner edge and a second, lower resonant frequency associated with the longer outer edge.

As an alternative, multiple resonant paths may be provided by forming the conductive pattern with a second resonant ring. Typically, therefore, the second resonant ring has a different electrical length from that of the first resonant ring, and is coupled to the first resonant ring and some of the open-circuit stubs. The first resonant ring and the second resonant ring may be circular and square respectively and may be concentric. In this embodiment, the inner resonant ring generally has a higher resonant frequency than the outer resonant ring. Each resonant ring has a respective set of open-circuit stubs connected to it. Each stub has an electrical length equivalent to a quarter wavelength at the resonant frequency of the resonant ring to which it is connected.

Any of the embodiments described above may have one or more sets of open-circuit stubs of spiral form, all having the same sense of rotation. Such an antenna is suitable for receiving electromagnetic radiation of either left-hand or right-hand circular polarisation, depending on the sense of rotation of the spiral form.

As an alternative embodiment of the invention, an antenna may have first and second sets of open-circuit stubs of spiral form, those of the second set having the opposite sense of rotation to the stubs of the first set. Such an antenna is responsive to electromagnetic radiation of both left-hand circular polarisation and right-hand circular polarisation.

The stubs may either be directly connected to the respective resonant ring or at least some of the stubs may be selectively coupled to the resonant ring by switching means. Such switching means may comprise a plurality of switching devices, e.g. capacitive MEMS (micro electro-mechanical system) switches.

Capacitive MEMS switches are devices across which the capacitance can be varied. When a radio frequency signal is applied across a capacitive MEMS switch in a state in which the switch has a large capacitance, the applied signal is transmitted across the switch, whereas if a radio frequency signal is applied across a capacitive MEMS switch in a state in which the switch has a small capacitance, the applied signal will not be transmitted across the switch. A capacitive MEMS switch may therefore act as a switch for radio frequency signals applied across the device.

In an antenna in which the conductive pattern comprises first and second sets of open-circuit stubs and a resonant ring structure, the antenna preferably includes integral switching devices arranged to couple the stubs selectively to the resonant ring structure.

A control system connected to the switching devices operates to determine the conductive state of each switching device. The control means may typically comprise circuitry provided separately from the antenna.

In the embodiment of the invention which provides both a first and second set of open-circuit stubs with each stub being of spiral form and each set of stubs having an opposite sense of rotation to the other set of stubs, the control system is operable to selectively couple either the first or the second set of open-circuit stubs to the respective resonant ring. This embodiment provides two control states: a first control state in which the stubs of the first set are connected to the resonant ring structure and the stubs of the second set are disconnected; and a second control state in which the stubs of the second set are connected to the resonant ring structure and those of the first set are disconnected.

According to another aspect of the invention, an antenna for circularly polarised radiation at an operating frequency in excess of 200 MHz comprises an insulative substrate having oppositely directed major faces, a conductive antenna element pattern on one of the major faces; and a conductive ground plane on the other major face, the ground plane being in registry with at least part of the conductive antenna element pattern to act as a reflector, wherein the conductive antenna element pattern comprises a resonant ring and a plurality of elongate open-circuit radiating elements coupled to the resonant ring at spaced apart locations thereon and extending outwardly from the resonant ring, the electrical length of at least some of the radiating elements being such that they are resonant at a resonant frequency of the resonant ring.

The antenna may be embodied as a single component or as a combination. In the latter case, one component of the antenna may comprise the substrate and the conductive pattern, the other comprising a host assembly providing a conductive ground plane to which one face of the substrate, opposite to a face thereof bearing the conductive pattern, is secured. The invention, therefore, also provides an antenna component to form part of a dielectrically loaded antenna for circularly polarised radiation at an operating frequency in excess of 200 MHz, comprising a dielectric substrate having oppositely directed major faces, and a conductive antenna element pattern on one of the major faces, wherein the conductive antenna element pattern comprises a resonant ring and a plurality of elongate open-circuit radiating elements coupled to the resonant ring at spaced apart locations thereon, and wherein each of at least some of the said radiating elements extends outwardly from the resonant ring in a direction which has both a radial component and a tangential component, the electrical length of each of at least some of the radiating elements being such that it is resonant at a resonant frequency of the resonant ring.

In this application, references to "radiating elements" are to be construed as meaning elements which, if the antenna is used for transmission, radiate energy to space. Such elements, when the antenna is used for receiving signals, receive energy from space in a reciprocal way.

The invention will be described below by way of example with reference to the drawings.

DETAILED DESCRIPTION OF PREFERRED EMBODIMENTS OF THE INVENTION

Figure 1A:
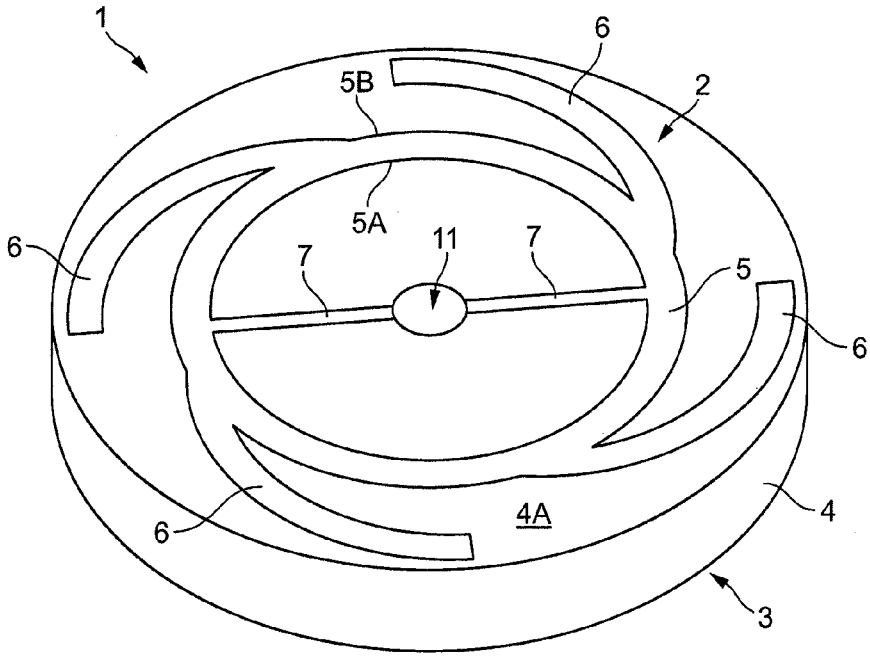
FIG. 1A is a perspective view of a first, single-frequency antenna in accordance with the invention, viewed from above and one side.
Figure 1B:
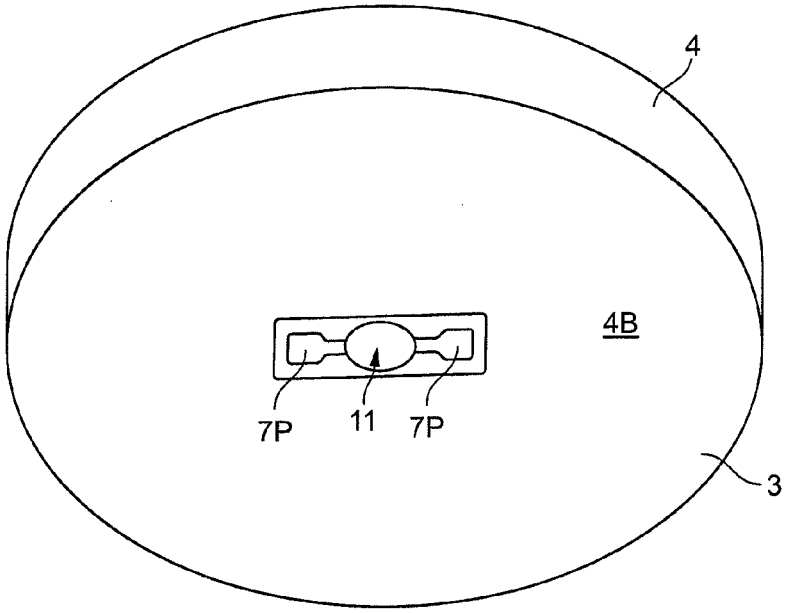
FIG. 1B is a perspective view of the antenna of FIG. 1A, viewed from beneath and from one side.

Referring to FIGS. 1A and 1B, a first antenna 1 in accordance with the invention has three layers: a conductive pattern 2, a conductive ground plane 3 and a substrate 4 disposed between the conductive pattern 2 and the ground plane 3.

The preferred form of the substrate 4 is a disc-shaped tile having upper and lower major faces 4A, 4B which are planar surfaces. For reasons of efficiency and small size, the material of the substrate 4 is a high dielectric constant ceramic material having, in this embodiment, a relative dielectric constant of 10. The operating frequency of the antenna is that of the GPS L1 frequency, i.e. 1575.42 MHz. At this frequency, the diameter of the substrate disc is 50 mm and the substrate thickness is 3 mm. Other materials may be used, typically having a higher relative dielectric constant. For instance, an alternative ceramic material having a relative dielectric constant of 21 yields an antenna in which the mean lateral dimension of the tile (the diameter in the case of a circular disc) is in the region of 20 mm and the thickness is about 1.2 mm.

The conductive pattern 2 is plated on the upper major face 4A of the substrate 4 and comprises a resonant ring 5 and four outwardly extending open-circuit stubs or monopole elements 6. The resonant ring 5 has an inner resonant edge 5A and an outer resonant edge 5B. Since the width of the track forming the ring 5 is relatively small in this embodiment, the ring can be considered to have a single resonant frequency, this resonant frequency being determined by the mean electrical length around the ring, which length depends on its physical length and the relative dielectric constant of the substrate material. The stubs 6 couple to the resonant ring 5 at positions uniformly spaced around the outer edge of the resonant ring 5B. In this case, the resonant ring 5 is circular and each stub 6 is an arc or quadrant with radius equal to that of the resonant ring 5. The stubs 6 all extend outwardly from the resonant ring 5 and are orientated to have the same sense of rotation.

In the centre of the resonant ring 5 there is a hole 11 in the substrate 4. A pair of plated feed paths 7 extend radially in opposite directions from the opening of the hole 11 to the resonant ring 5. These feed paths 7 continue from the opening of the hole 11 through the hole 11 to the other major face of the substrate disc as plated tracks on opposing sides of the wall of the hole 11. As shown in FIG. 1B, the feed paths 7 terminate in a pair of plated connection pads 7P forming balanced feed nodes for connecting the antenna to additional circuitry, not shown, without making an electrical connection to ground plane 3.

Typically, such additional circuitry includes a matching capacitance, shunt-connected across the feed nodes which, in combination with the inductances formed by the relatively narrow tracks of the feed paths 7, constitute an impedance matching circuit to yield, in this embodiment, a 50 ohm source impedance.

Referring to FIG. 2, an antenna suitable for receiving signals at two frequencies has a first resonant ring 5-1 and a second resonant ring 5-2. The first resonant ring 5-1 is circular while the second resonant ring 5-2 is square, the latter being coupled to the former at four points equally spaced around both rings so that the first and second resonant rings 5-1, 5-2 are concentric.

The average electrical length of the second ring 5-2 is greater than that of the first resonant ring 5—and, therefore, defines a lower resonant frequency than does the first resonant ring 5-1.

Coupled to the first and second resonant rings 5-1, 5-2 are a plurality of stubs. A first set of stubs 6-1 has an electrical length of a quarter of that of the first resonant ring 5-1, while a second set of stubs 6-2 has an electrical length of a quarter of that of the second resonant ring 5-2. The first set of stubs 6-1 is coupled to the first resonant ring 5-1 at equidistant points around the first resonant ring 51. The second set of stubs 6-1 is coupled to the second resonant ring 5-1 at equidistant points around the second resonant ring 5-1. Both first and second sets of stubs 6-1, 6-2 extend outwardly from the first and second resonant rings 5-1, 5-2. All of the stubs 6-1, 6-2 are orientated to have the same sense of direction.

In the centre of the first and second resonant rings 5-1, 5-2 there is a hole 11 in the substrate 4, as in the antenna described above with reference to FIGS. 1A and 1B, and the feed paths 7 continue through the central aperture or hole 11 to connection pads 7P, as also described above.

This second antenna is intended for use at the GPS L1 and L2 frequencies, the resonant ring 5-2 and the associated longer stubs 6-2 defining a circular polarisation resonance at the GPS L2 frequency of 1227.6 MHz.

Figure 2A:
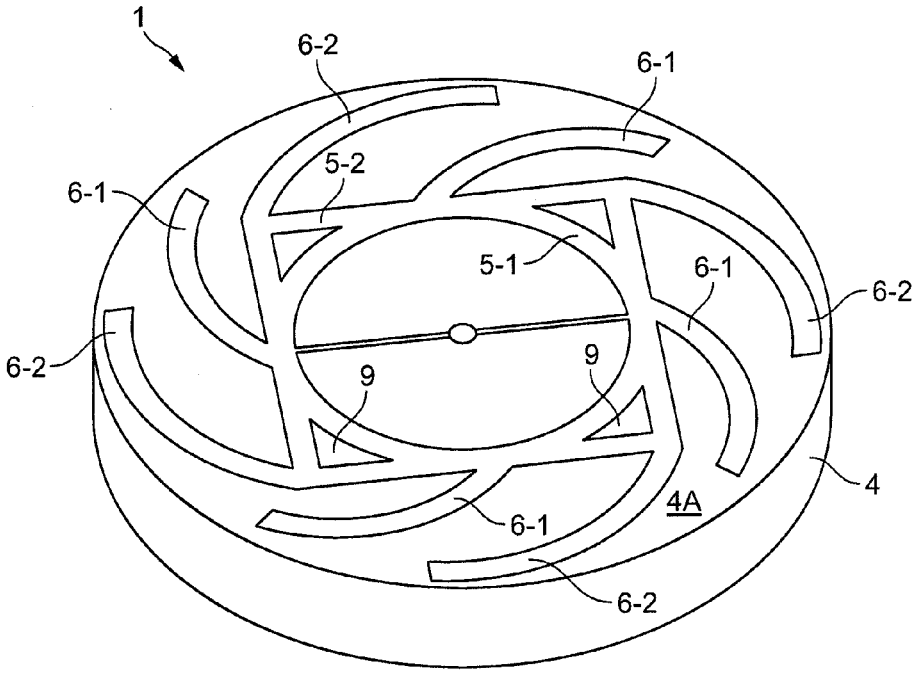
FIG. 2A is a perspective view of a dual-frequency antenna in accordance with the invention.
Figure 2B:
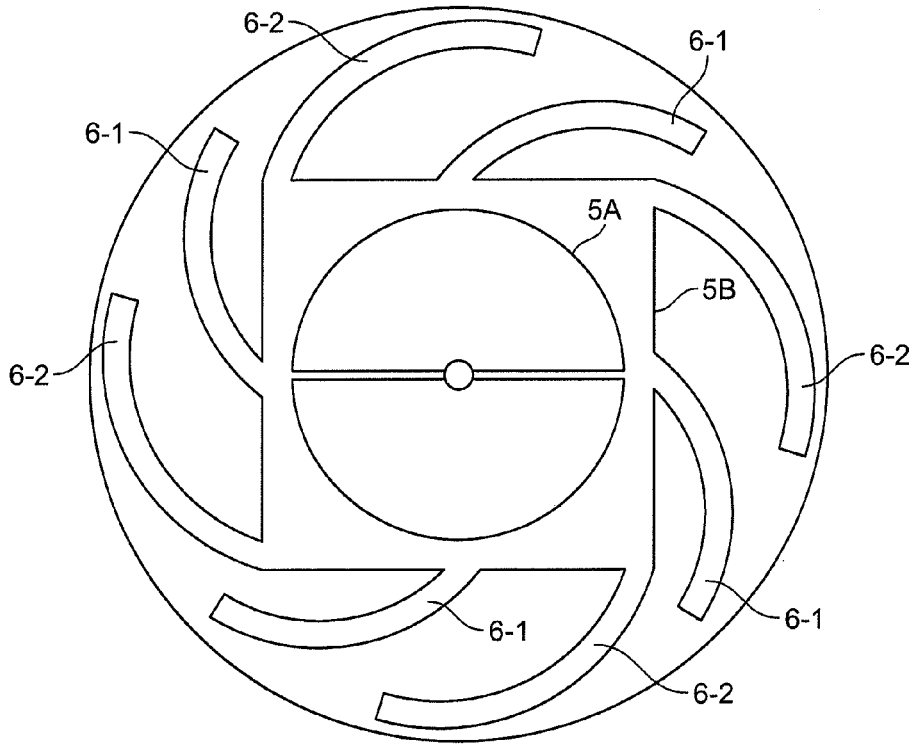
FIG. 2B is a plan view of an alternative dual-frequency antenna in accordance with the invention.

In a variant of the antenna of FIG. 2A, the four quadrant-shaped spaces 9 between the first and second resonant rings 5-1, 5-2 are plated across, as shown in FIG. 2B, so that the antenna, in physical terms, has a single ring with inner and outer edges 5A, 5B of widely differing lengths yielding, respectively, inner and outer resonant paths determining the two resonant frequencies of the antenna.

Figure 3A:
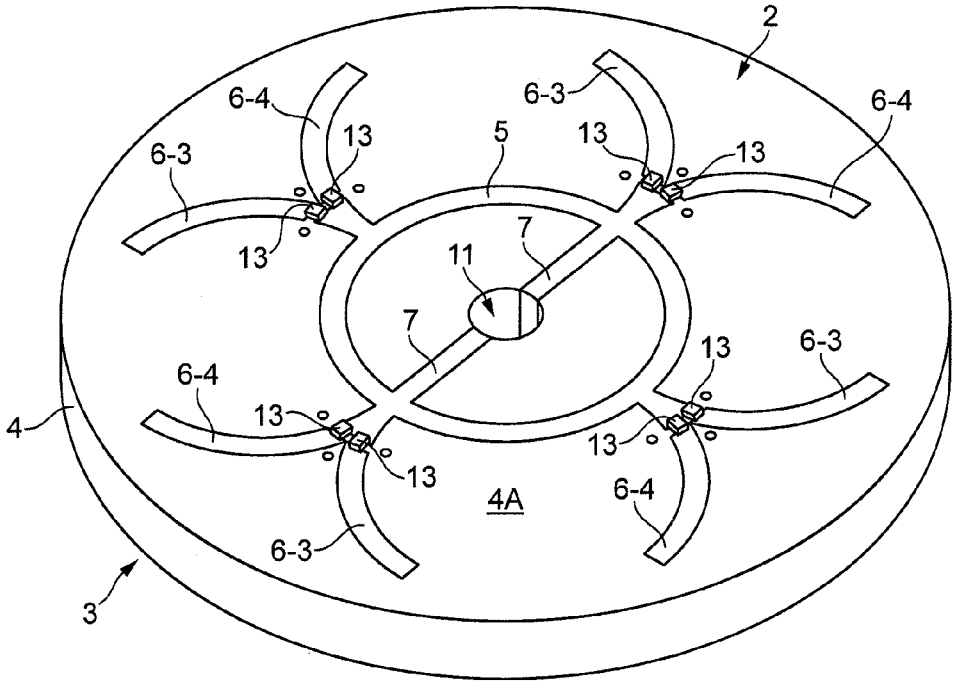
FIG. 3A is a perspective view of a dual-polarisation antenna in accordance with the invention, viewed from above and one side.
Figure 3B:
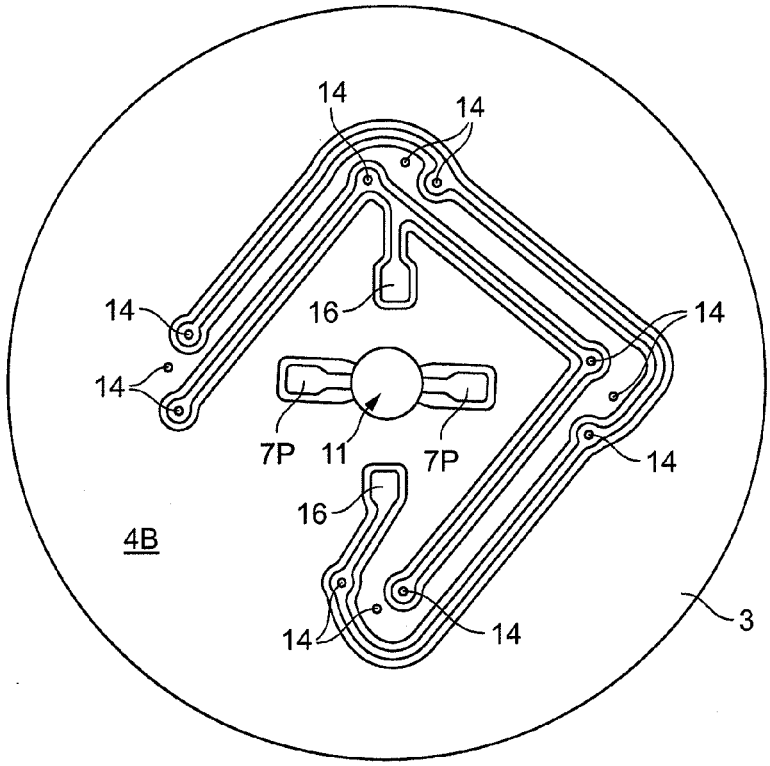
FIG. 3B is an underside view of the antenna of FIG. 3A.

Referring now to FIGS. 3A and 3B, a fourth antenna in accordance with the invention, like the antenna described above with reference to FIGS. 1A and 1B, has a conductive pattern 2 with a single resonant ring 5, defining a single resonant frequency. However, in this antenna, the conductive pattern 2 has first and second sets of stubs 6-3, 6-4 with opposite senses of rotation, as shown in FIG. 3A. As in the antennas described above, there is a hole 11 in the substrate 4 located in the centre of the resonant ring 5. Again, there is a ground plane 3 on the lower major face 4B of the substrate 4. The relative dielectric constant of the material of the substrate 4 is 10.

The stubs of both the first and second sets 6-3, 6-4 extend outwardly from the resonant ring 5. Both stubs 6-3, 6-4 and stubs are of spiral form and couple to the resonant ring at common locations 12. At each coupling location 12, one stub 6-3 of the first set and one stub 6-4 of the second set is coupled to the resonant ring 5, and there are eight stubs 6-3, 6-4 altogether.

Although the stubs 6-3, 6-4 are of spiral form, they have an opposite senses of rotation. The paths of the stubs 6-3 of the first set rotates outwardly from a point of coupling 12 with the ring in an anti-clockwise direction, while the paths of the stubs 6-4 of the second set rotate outwardly from points of coupling 12 with the ring 5.

The stubs 6-3 and 6-4 are of equal length, each having an electrical length, from the point at which it couples to the resonant ring 5 to its open-circuit end, which is a quarter of the electrical length of the resonant ring 5.

The stubs 6-3 and 6-4 are coupled to the resonant ring 5 via respective MEMS switching elements 13, each stub 6-3, 6-4 having a respective MEM element 13. By operating these switches in such a way that, in one mode of operation, only the stubs 6-3 of the first set are coupled to the ring 5 and, in another mode, only the stubs 6-4 of the second set are coupled to the ring 5, the antenna can be configured to operate for left-hand circularly polarised waves and right-hand circularly polarised waves respectively, according to control signals fed to the switches. One application for such an antenna is for receiving DVB SH (Digital Video Broadcasting: Satellite services to Handhelds) signals which are S-band signals transmitted, typically, in a band from 2.1 to 2.2 GHz, different channels having either left-hand or right-hand circular polarisation respectively.

The MEMS switches are preferably capacitive devices such as those made by Wispry which may have series capacitances of, alternately, about 1 pF and 100 pF, according to the control voltage, these values representing the open-circuit state and closed-circuit state respectively at the frequencies of operation of the antenna.

By operating the MEMS switches 13, as described above, respective stubs 6-3, 6-4 are either effectively connected to the ring 5 or isolated therefrom according to the state of the switch 13, in each case. Thus, it is possible to isolate one set of stubs whilst electrically connecting the other set, configuring the antenna for right-hand circular polarisation or left-hand circular polarisation respectively.

Figure 3C:
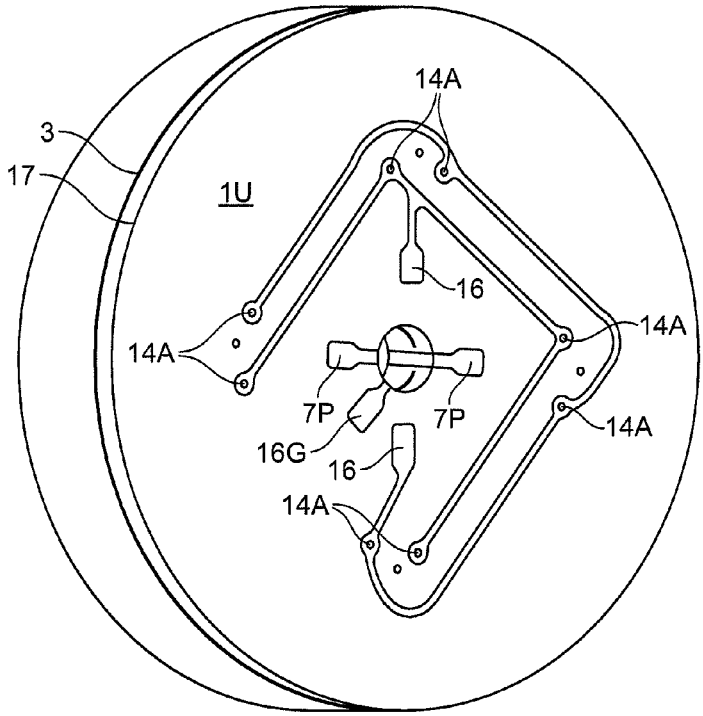
FIG. 3C is an underside view of a variant of the antenna of FIGS. 3A and 3B.

Control lines for the MEMS switches 13 are typically provided in a lower conductive layer of the antenna, i.e. beneath the upper major face 4A, vias 14 being provided to couple the tracks of the lower layer to connections to the MEMS switches 13 on the upper major face 4A, as shown in FIG. 3B. Control line termination pads 16 are provided on the underside of the antenna, as shown. In the version shown in FIG. 3B, the control lines form part of the same conductive layer as the ground plane. Should it be preferred that the ground plane not be interrupted in this way, the substrate may have an additional conductive layer, one containing the ground plane 3 and the other containing the control lines plated on a superimposed insulative layer 17, appropriate vias and connection pads being provided, as shown in FIG. 3C. In this variant, the ground plane 3 is continuous expect for clearance apertures (not shown) around the control line vias 14A and the connections between the feed pads 7P and the feed paths 7 (FIG. 1A) on the upper face 4A of the substrate. A fifth pad 16G on the underside 1U of the antenna provides a connection to the ground plane 3 as a ground for the MEMS switch control circuit.

Figure 3D:
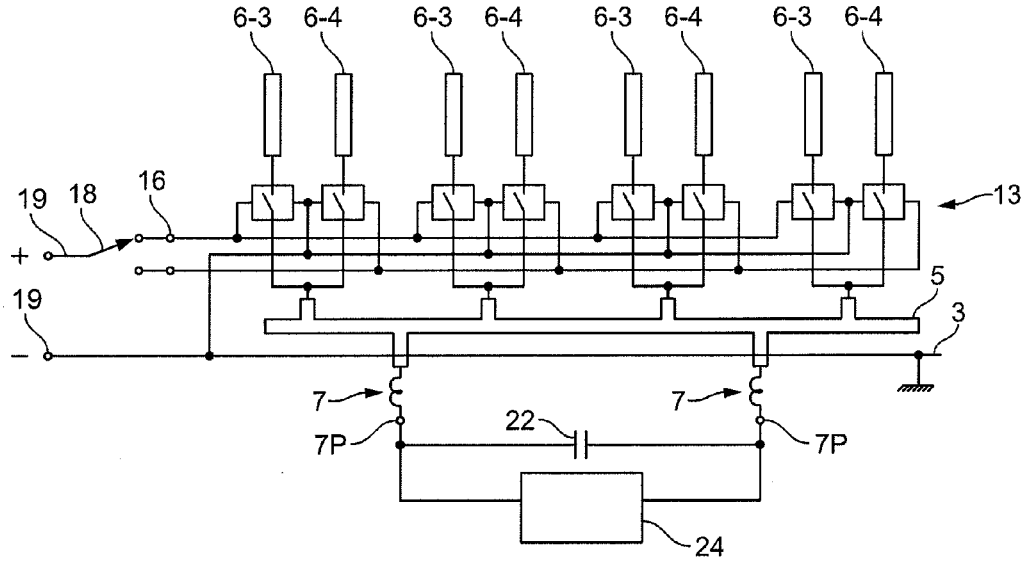
FIG. 3D is a circuit diagram of the antennas of FIGS. 3A, 3B and 3C and associated equipment circuitry.

Referring to FIG. 3D, suitable additional circuitry comprises an external mode control switch 18 for coupling a control voltage supplied across control input lines 19 to, alternately, the switches 13 associated with the first set of stubs 6-3 and the switches 13 associated with the second set of stubs 6-4. The additional circuitry also comprises a shunt matching capacitance 22 and a receiver front end 24 having a balanced input.

Figure 4:
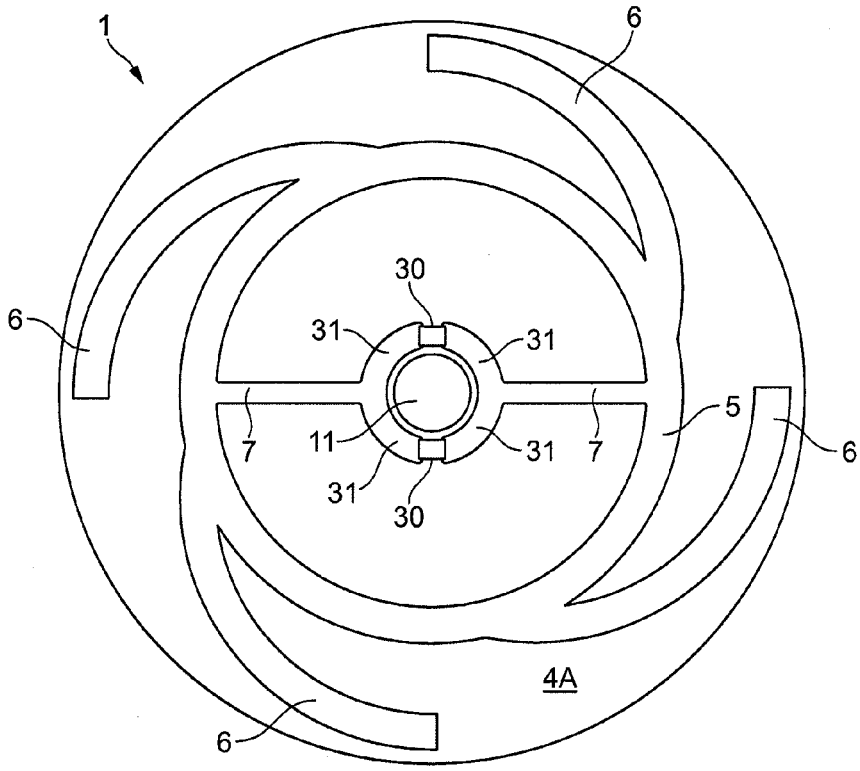
FIG. 4 is a plan view of a first variant of the antenna of FIGS. 1A and 1B.
Figure 5:
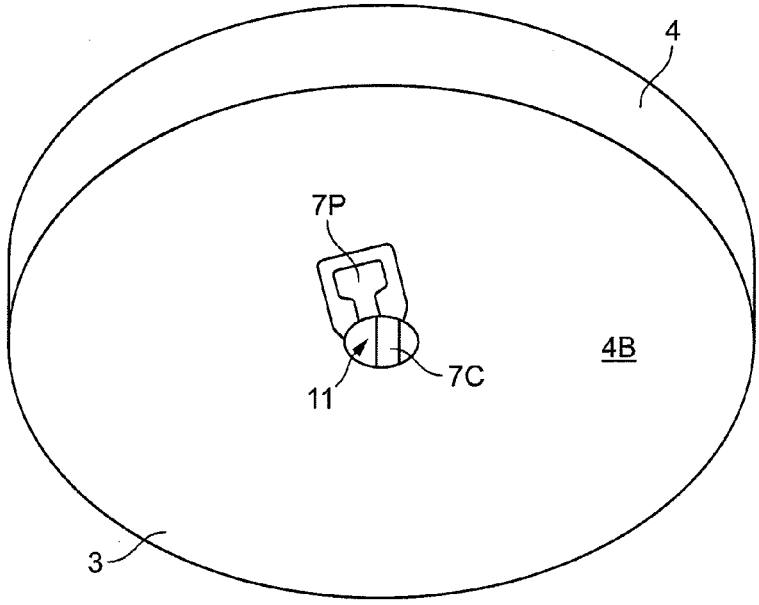
FIG. 5 is a perspective view of a second variant of the antenna of FIGS. 1A and 1B, viewed from beneath and one side.
Figure 6A:
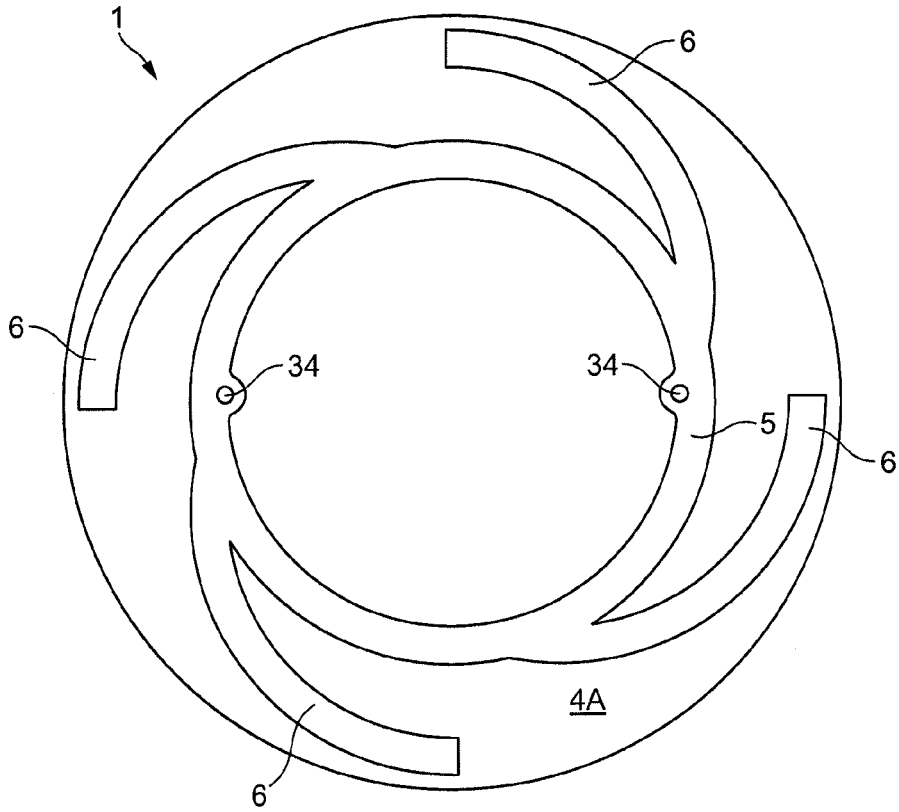
FIG. 6A is a plan view of a third variant of the antenna of FIGS. 1A and 1B.
Figure 6B:
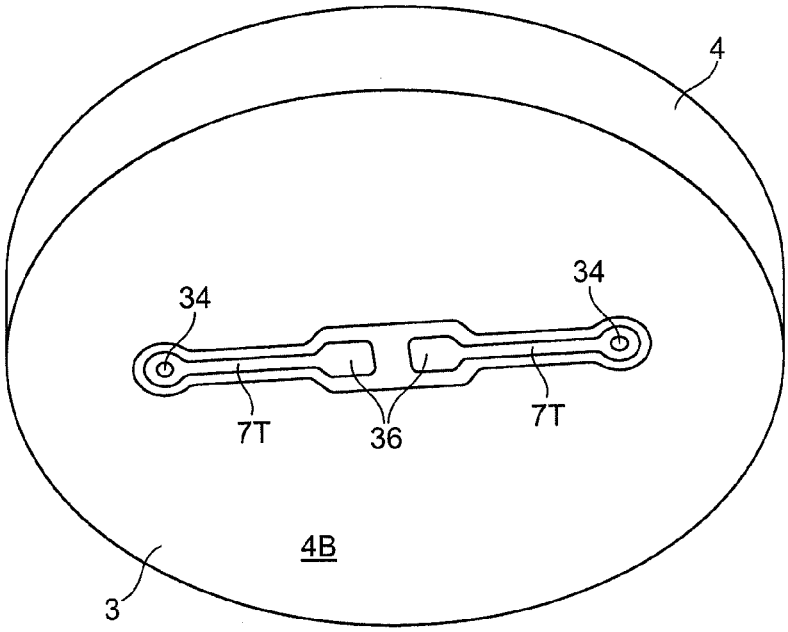
FIG. 6B is a perspective view of the third variant shown in FIG. 6A, viewed from beneath and one side.

Further antenna variants will now be described with reference to FIGS. 4, 5, 6A and 6B. FIG. 4 is a variant of the antenna of FIGS. 1A and 1B in which, rather than providing a shunt matching capacitor in a separate structure to which the antenna 1 is connected, in this case, a matching capacitance is provided between the inner ends of the feed paths 7, adjacent the through-hole 11 on the upper major face 4A of the antenna. More specifically, the shunt capacitance is constituted by two chip capacitors 30 located on the upper major face 4A on opposite sides of the hole 11A, and associated capacitor connection tracks 31. Referring to FIG. 5, the inner end 7C of one of the feed paths 7 may be connected directly to the ground plane 3, in this case at the lower opening of the hole 11, as shown. The other feed path 7 is terminated in an isolated connection pad 7P. As a further variant, the feed paths 7 may be formed on the lower major face 4B as in the antenna shown in FIGS. 6A and 6B. Thus, in this case, vias 34 are provided at diametrically opposite locations on the ring 5. On the underside, as shown in FIG. 6B, the feed paths extend radially inwardly as tracks 7T from the vias 34 to integral central connection pads 36. In this case, no central hole is required. As another alternative, the vias 34 may end in connection pads directly adjacent the vias, and the feed paths, instead of interrupting the ground plane 3, are formed in a host board or other host structure to which the antenna is mounted during installation.

As stated hereinabove, it is not essential for the ground plane to be formed on the substrate 4. Instead, it may be constituted by a conductive layer on a host board or other host structure, to which the lower substrate face 4B is secured during installation, connections being made between the resonant ring or the feed paths, and conductors in the host structure during installation. Similarly, control lines for MEMS switches in a switchable antenna such as those described above with reference to FIGS. 3A to 3D, may be incorporated in the host structure, individual connections for the respective MEMS switches being provided between the substrate 4 and the host structure.

What is claimed is:

1. An antenna component to form part of a dielectrically loaded antenna for circularly polarised radiation at an operating frequency in excess of 200 MHz, comprising:

a dielectric substrate having oppositely directed major faces; and a conductive antenna element pattern overlying one of the major faces;

wherein the conductive antenna element pattern comprises a resonant ring and a plurality of elongate open-circuit radiating elements coupled to the resonant ring at spaced apart locations thereon, and wherein each of at least some of the said radiating elements extends outwardly from the resonant ring in a direction which has both a radial component and a tangential component, the electrical length of each such radiating element being such that it is resonant at a resonant frequency of the resonant ring.

2. An antenna component according to claim 1, including a pair of inner feed connection nodes and a pair of substantially radial feed connection conductors extending inwardly to the feed connection nodes from substantially opposite locations on the resonant ring.

3. An antenna component according to claim 1, wherein the substrate is made of a dielectric material having a relative dielectric constant greater than 5, and the major faces are planar and parallel and are separated by a distance which is less than a quarter of the average transverse extent of the major faces.

4. An antenna for circularly polarised radiation at an operating frequency in excess of 200 MHz, comprising an insulative substrate having oppositely directed major faces;

a conductive antenna element pattern on one of the major faces; and a conductive ground plane on the other major face, the ground plane being in registry with at least a major part of the conductive antenna element pattern to act as a reflector;

wherein the conductive antenna element pattern comprises a resonant ring and a plurality of elongate open-circuit radiating elements coupled to the resonant ring at spaced apart locations thereon, and wherein each of at least some of the said radiating elements extends outwardly from the resonant ring in a direction which has both a radial component and a tangential component, the electrical length of each such radiating element being such that it is resonant at a resonant frequency of the resonant ring.

5. An antenna according to claim 4, including a pair of inner feed connection nodes and a pair of substantially radial feed connection conductors extending inwardly to the feed connection nodes from substantially opposite locations on the resonant ring.

6. An antenna according to claim 5, wherein the feed connection conductors are on said one major face of the substrate and the antenna further comprises feed conductors extending through the substrate from inner ends of the feed connection conductors.

7. An antenna according to claim 5, wherein the feed connection conductors are on said other major face of the substrate and are connected to the resonant ring by respective vias passing through the substrate.

8. An antenna according to claim 4, wherein the resonant ring is circular.

9. An antenna according to claim 4, wherein the conductive antenna element pattern comprises:

a resonant ring structure defining first and second annular conductive paths of different electrical lengths and defining first and second resonant frequencies, the first annular conductive path lying generally within the second annular conductive path;

a first set of elongate open-circuit radiating elements extending outwardly from spaced apart locations on the resonant ring structure, the lengths of the elements being such that they are resonant at the resonant frequency of the first annular conductive path; and a second set of elongate open-circuit radiating elements extending outwardly from spaced apart locations on the resonant ring structure so that they lie respectively between the elements of the first set, the lengths of the elements of the second set being such that they are resonant at the resonant frequency of the second annular conductive path.

10. An antenna according to claim 4, wherein said open-circuit radiating elements are of spiral shape.

11. An antenna for circularly polarised radiation at an operating frequency in excess of 200 MHz, comprising an insulative substrate, a conductive ground plane and a conductive pattern, wherein:

at least a portion of the substrate is disposed between the conductive pattern and the ground plane;

the conductive pattern includes a resonant ring and a plurality of open-circuit stubs coupled to the resonant ring;

each of a plurality of the stubs has an electrical length of a quarter wavelength at the resonant frequency of the resonant ring to which it is coupled and extends outwardly from the ring in a direction which has both a radial component and a tangential component.

12. An antenna according to claim 11, further comprising a plurality of feed paths coupled to and extending inwardly from the resonant ring to an antenna feed connection.

13. An antenna according to claim 11, wherein the resonant ring defines an inner resonant path and an outer resonant path of different electrical lengths and different resonant frequencies.

14. An antenna according to claim 11, comprising inner and outer substantially concentric resonant rings, wherein the outer resonant ring has an electrical length which is different from that of the inner resonant ring, and is coupled to the inner resonant ring and to a plurality of the stubs.

15. An antenna according to claim 14, wherein the inner resonant ring and the outer resonant ring have outer edges defining respective different resonant conductive paths of different resonant frequencies.

16. An antenna according to claim 14, wherein said plurality of the stubs connected to the outer resonant ring have an electrical length of a quarter wavelength at the resonant frequency of the outer resonant ring.

17. An antenna according to claim 11, wherein the stubs include a first set of stubs of spiral form having the same sense of rotation.

18. An antenna according to claim 17, wherein the stubs include a second set of stubs of spiral form having the opposite sense of rotation from that of the stubs of the first set, whereby the antenna is responsive to electromagnetic radiation of left-hand circular polarisation and electromagnetic radiation of right hand circular polarisation.

19. An antenna according to claim 11, wherein at least some of the stubs are directly connected to the resonant ring.

20. An antenna according to claim 11, including switching means coupling at least some of the stubs to the resonant ring.

21. An antenna according to claim 20, wherein the switching means comprise a plurality of switching devices.

22. An antenna according to claim 21, wherein the switching devices comprise capacitive MEMS switches.

23. An antenna according to claim 11, wherein the conductive pattern comprises first and second sets of open-circuit stubs and a resonant ring structure, and wherein the antenna further comprises integral switching devices arranged to couple the stubs selectively to the resonant ring structure.

24. An antenna according to claim 23, including a plurality of switching device control lines interconnected such that energisation of a first set of the control lines causes the first set of stubs to be connected to the resonant ring structure and energisation of a second set of the control lines causes the second set of stubs to be connected to the resonant ring structure.

25. An antenna according to claim 23, wherein the stubs of the first set and those of the second set extend in an anticlockwise direction and a clockwise direction respectively.

26. An antenna according to claim 23, wherein the first set of stubs has four outwardly extending stubs substantially uniformly distributed around the resonant ring and wherein the second set of stubs has four outwardly extending stubs substantially uniformly distributed around the resonant ring and located respectively between the stubs of the first set.

27. An antenna system comprising an antenna according to claim 23 and a control system connected to the switching devices, wherein the control system and its connection to the switching devices are arranged such that in a first control state of the control system, the first set of stubs is connected to the resonant ring structure and the second set of stubs is disconnected, and in a second control state of the control system, the second set of stubs is connected to the resonant ring structure and the first set of stubs is disconnected.

28. An antenna according to claim 11, wherein the substrate is formed as a tile having one surface bearing the conductive pattern and an oppositely directed surface bearing the ground plane, the surfaces being parallel and spaced apart by a distance equivalent to less than 15 degrees of the wavelength in the material of the substrate at an operating frequency of the antenna.

29. An antenna according to claim 11, wherein the substrate is formed as a tile having one surface bearing the conductive pattern and an oppositely directed surface bearing the ground plane, the surfaces being parallel and spaced apart from a distance equivalent to less than 10 degrees of the wavelength in a material of the substrate at an operating frequency of the antenna.

* * * * *